US005470264A

United States Patent [19]

Eick

[11] Patent Number: 5,470,264

[45] Date of Patent: Nov. 28, 1995

[54] MARINE DRIVE SHIFT SHAFT MOUNTING SYSTEM

[75] Inventor: Edward C. Eick, Stillwater, Okla.

[73] Assignee: Brunswick Corporation, Lake Forest, Ill.

[21] Appl. No.: 339,938

[22] Filed: Nov. 15, 1994

[51] Int. Cl.[6] ..... B63H 23/34

[52] U.S. Cl. ..... 440/83

[58] Field of Search ..... 440/53, 49, 75, 440/83; 464/170, 178

[56] References Cited

U.S. PATENT DOCUMENTS

| | | | |
|---|---|---|---|
| 2,937,414 | 5/1960 | Cotchett | 464/170 |
| 3,491,555 | 1/1970 | Arndt et al. | 464/170 |
| 3,868,833 | 3/1975 | Noe et al. | 464/170 |
| 4,424,045 | 1/1984 | Kulischenko et al. | 464/170 |
| 4,430,905 | 2/1984 | Bruguera | 464/170 |
| 4,789,377 | 12/1988 | Huskins | 464/170 |
| 4,848,775 | 7/1989 | Lough . | |
| 5,052,958 | 10/1991 | Entringer et al. . | |

*Primary Examiner*—Stephen Avila

*Attorney, Agent, or Firm*—Andrus, Sceales, Starke & Sawall

[57] ABSTRACT

A device is provided for isolating a shift shaft extending through an exhaust passage of a bell housing in a marine drive system. The device includes an elongated sleeve for receiving the shift shaft therein. The sleeve has a first portion sealably mounted in a first bore extending through the top wall of the exhaust passage and a second portion sealably mounted in a second bore which extends through the bottom wall of the exhaust passage. The elongated sleeve prevents galvanic corrosion and erosion of the aluminum housing and the stainless steel shaft.

6 Claims, 1 Drawing Sheet

FIG. 1
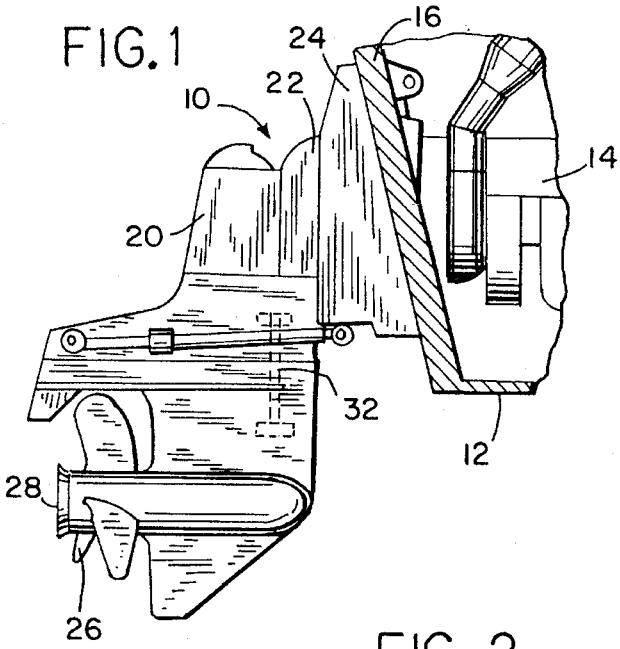
FIG. 2
PRIOR ART
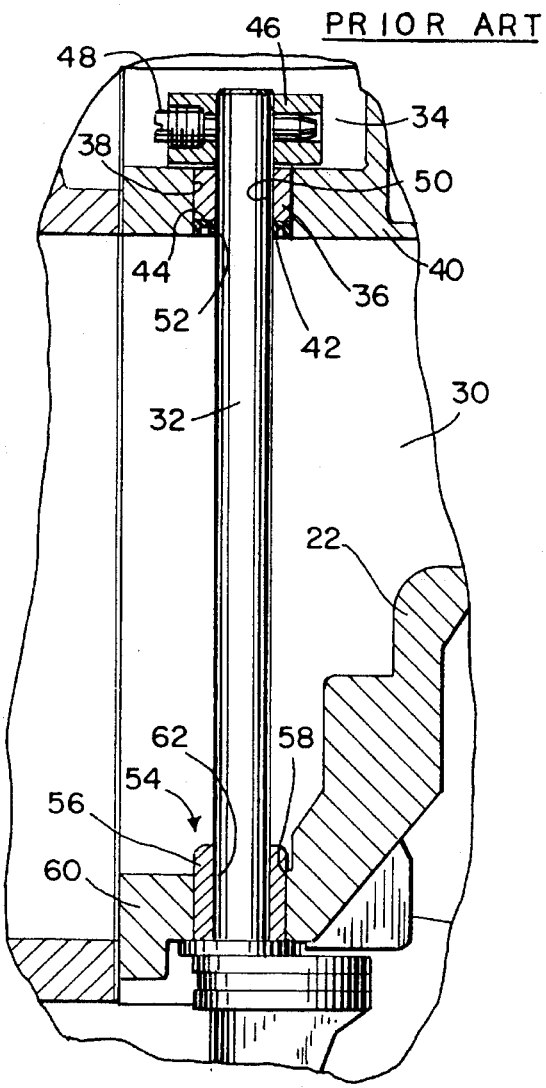
FIG. 3
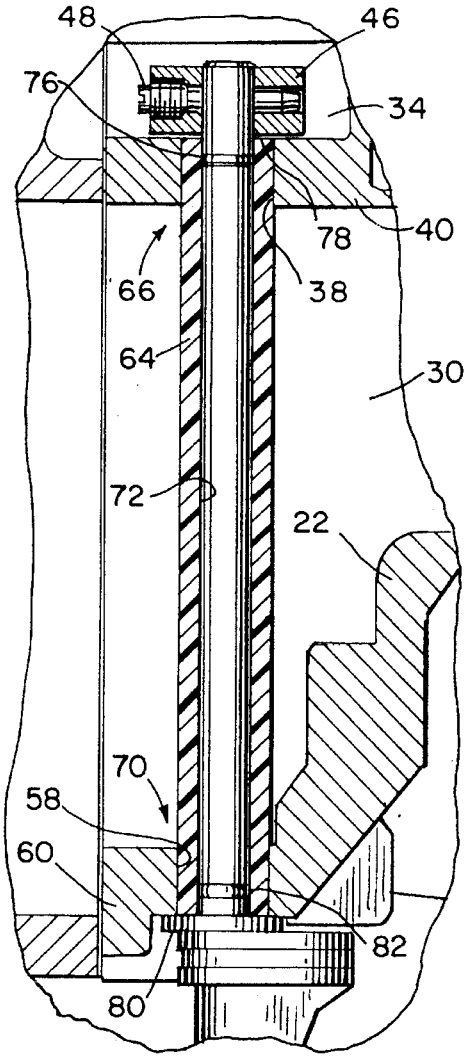
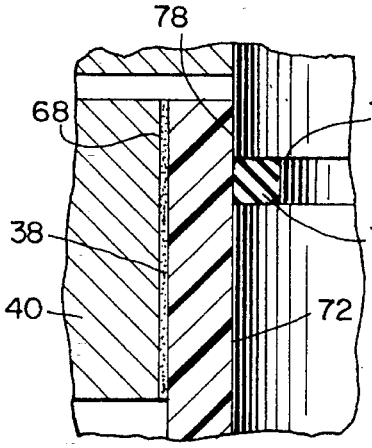
FIG. 4

MARINE DRIVE SHIFT SHAFT MOUNTING SYSTEM

BACKGROUND AND SUMMARY OF THE INVENTION

This invention relates to a marine drive system and, more particularly, to a sleeve to isolate the stainless steel shift shaft within the drive.

In a marine drive unit, a gearcase dog clutch is used for shifting the engine. The gearcase dog clutch is coupled to an upper shift shaft portion that is positioned in the center of an exhaust passageway. The shift shaft is made of stainless steel for strength and corrosion resistance.

The shaft is supported on each end by oil impregnated bronze bearings pressed into an aluminum die cast bell housing. The upper bronze bearing abuts an oil seal to limit the entry of sea water into a shift actuator cavity. Above normal sea water temperatures within the bell housing exhaust cavity cause galvanic corrosion of the shaft and erosion of the aluminum housing. The non-functional binding caused by the galvanic corrosion impairs shifting.

Therefore, it is the primary objective of this invention to provide a device to isolate the shift shaft from sea water and to prevent galvanic corrosion and binding of the stainless steel shifting shaft.

It is a further objective of this invention to provide a device which isolates a shift shaft within a marine drive and prevents entry of sea water into the shift actuator cavity.

It is a still further objective of this invention to provide a device for isolating a shift shaft in a marine drive without impairing the shifting function of the engine.

In accordance with the invention, a device is provided which isolates a shift shaft extending through a bell housing in a marine drive system from sea water within the bell housing exhaust cavity. The exhaust cavity has a first bore extending through a bottom wall of the bell housing and a second bore which extends through a portion of the bell housing between the exhaust passage and the shift actuator cavity. The first bore and the second bore are on opposite sides of the exhaust cavity and the shift shaft extends therethrough.

The shift shaft is provided with one or more grooves extending radially about the outer surface of the shaft. It is preferred to have a pair of annular grooves spaced along the shift shaft. A radial seal is located within each spaced annular groove on the shift shaft.

An elongated sleeve, preferably of inert plastic, is provided for receiving the shift shaft therein. The inner diameter of the sleeve is such that each radial seal engages the inner surface of the sleeve thereby preventing air and/or sea water from entering the interior of the elongated sleeve from the shift actuator cavity or from outside of the bell housing. In addition, the interface between the sleeve and the seals acts as a bearing surface for the shaft.

The elongated sleeve extends along the entire length of a portion of the shift shaft. The sleeve has a first end sealably mounted in the first bore and a second end sealably mounted in the second bore. The sleeve is mounted in each bore by use of an adhesive so as to prevent sea water from entering the shift actuator cavity through the first bore or from leaving the bell housing through the second bore.

BRIEF DESCRIPTION OF THE DRAWINGS

The drawings illustrate the best mode presently contemplated for carrying out the invention.

FIG. 1 is a view, partially in section, of a marine stern drive system incorporating the device for isolating a shift shaft of this invention.

FIG. 2 is an enlarged partial sectional view, with portions broken away, showing the prior art arrangement.

FIG. 3 is an enlarged partial sectional view, with portions broken away, showing the device for isolating a shift shaft of this invention.

FIG. 4 is an enlarged partial sectional view, with portions broken away, showing a portion of the device of FIG. 3.

DETAILED DESCRIPTION OF THE PREFERRED EMBODIMENT

FIG. 1 shows a marine stern drive 10 including a boat 12 having an engine 14 mounted to a transom 16. The marine drive 10 has a drive shaft housing 20 including a bell housing 22 mounted to gimbal ring and housing 24 which, in turn, is mounted to a transom 16. A vertical drive shaft in drive shaft housing 20 is driven by an output shaft and, in turn, drives a propeller shaft to rotate propeller 26 and propel the marine drive 10, as is known. The bell housing 22 contains an exhaust passage 30, FIG. 2,3, directing exhaust gas and cooling water from the engine 14 downwardly through the drive shaft housing 20 and exiting through the hub 28 of the propeller.

1. Prior Art

FIG. 2 shows a vertical shift shaft 32 extending through exhaust passage 30 into a shift actuator cavity 34, sometimes referred to as a gimbal passageway. The above normal sea water temperatures within the bell housing exhaust cavity 30 cause galvanic corrosion of the aluminum housing 22 and of shift shaft 32.

The vertical shift shaft 32 is journaled in the bell housing 22 by a bushing 36 in a vertical bore 38 in a horizontal section 40 of the bell housing 22. A radial seal 42 is placed about shift shaft 32 and positioned within vertical bore 38 so as to abut bushing 36 along its lower horizontal surface 44. Shift shaft 32 is rotated about its vertical axis by upper operator controlled linkage connected to shift lever 46 by means of set screw 48 to operate the lower dog clutch between neutral, forward and reverse gears, all as is known in the art.

The inner diameter of bushing 36 provides a bearing surface 50 for the shift shaft 32 in bore 38. The inner diameter of radial seal 42 provides a second bearing surface 52 for shift shaft 32 in bore 38. Over a period of extended usage without proper maintenance, particularly in salt water, corrosion from exhaust gas and cooling water may cause bushing 36 to contract radially inward toward shift shaft 32 and tend to bind the shift shaft and impede rotation thereof.

Another type of seal assembly has been disclosed in U.S. Pat. No. 4,848,775 to Lough, but such seal assembly provides an upper bushing portion to rotatably support the shift shaft. However, applicant has employed a different design where an upper bushing portion contains a cut-away relief so as to eliminate binding which may be caused by corrosion.

A second end 54 of shift shaft 32 is journaled in the bell housing 22 by a bushing 56 in a vertical bore 58 in a second horizontal section 60 of the bell housing 22. The inner diameter of bushing 56 provides a bearing surface 62 for shift shaft 32 in bore 58. The interface of bushing 56 and bore 58 in section 60 of the bell housing 22 is also subject to corrosion from exhaust gas and cooling water. Over a period of extended usage without proper maintenance, corrosion may cause bushing 56 to contract radially inward toward shift shaft 32 and tend to bind the shift shaft and impede rotation thereof. One desirable solution has been found in the use of a bushing of the type that has been disclosed in U.S. Pat. No. 5,052,958, and assigned to a common assignee.

2. Present Invention

FIG. 3 shows the present invention and uses like reference numerals from FIG. 2 where appropriate to facilitate understanding. An elongated sleeve 64 has a first end 66 which provides an outer diameter approximately the same as the diameter of bore 38 and received therein. An adhesive 68 is placed in the interface of the end 66 of elongated sleeve 64 and the bore 38 in section 40 of the bell housing 22. The adhesive provides a seal such that exhaust gas and cooling water does not exit the exhaust passage 30 and enter the shift actuator cavity 34.

The elongated sleeve 64 has a second end 70 having an outer diameter substantially matching the diameter of bore 58 in section 60 of the bell housing 22 and received therein. An adhesive is also provided in the interface between end 70 of elongated sleeve 64 and bore 38. The adhesive provides a seal such that exhaust gas and cooling water does not exit the exhaust passage 30 through bore 58.

The elongated sleeve 64 has an inner diameter greater than the diameter of shift shaft 32 such that the shift shaft 32 does not bind against surface 72 of sleeve 64.

The shift shaft 32 includes a first annular groove 74 for receipt of an annular O-ring 76. The annular ring 76 engages the elongated sleeve 74 thereby forming a bearing and sealing surface 78 for supporting shift shaft 32 for rotation and for the external sealing of air and water.

A second annular groove having an annular O-ring 80 therein is also provided. The annular ring 80 also engages the elongated sleeve 64 thereby forming a bearing and sealing surface 82 for supporting shift shaft 32 for rotation and for preventing air and sea water from contacting the shift shaft 32.

It can be seen through the description of this invention that various equivalents are possible without deviating from the scope and spirit of this invention.

I claim:

1. A shift shaft assembly for a marine drive system, comprising:

a housing including a passage defined by a bottom wall having a first bore extending therethrough, and a top wall having a second bore extending therethrough;

a shift shaft having a first end portion extending into the first bore in the bottom wall of the passage and a second end portion extending into the second bore in the top wall of the passage; and an elongated, tubular sleeve having an inner surface defining a shift shaft receiving passage for receiving of the shift shaft therethrough, the sleeve extending through the passage and having a first end sealably mounted in the first bore about the first end portion of the shift shaft, and a second end sealably mounted in the second bore about the second end portion of the shift shaft.

2. The shift shaft assembly of claim 1 wherein each end of the elongated sleeve is mounted in one of the bores by an adhesive.

3. The shift shaft assembly of claim 2 wherein the adhesive is a sealant.

4. The shift shaft assembly of claim 1 wherein the shift shaft includes a first annular groove extending radially about a first portion of the shift shaft and a second annular groove extending radially about a second portion of the shift shaft.

5. The shift shaft assembly of claim 2 further comprising first and second radial seals seated in the first and second annular grooves, respectively, in the shift shaft, wherein each seal engages the inner surface of the tubular sleeve so as to form a bearing surface for supporting the shift shaft and preventing the flow of air and water therepast.

6. The shift shaft assembly of claim 5 wherein each radial seal is an O-ring.

* * * * *